US010881134B2

(12) United States Patent
Mishra et al.

(10) Patent No.: US 10,881,134 B2
(45) Date of Patent: Jan. 5, 2021

(54) USE OF PECTIN OR OTHER ANIONIC POLYMERS IN THE STABILIZATION AND CONTROLLED RELEASE OF NICOTINE IN ORAL SENSORIAL TOBACCO PRODUCTS OR NICOTINE CONTAINING NON-TOBACCO ORAL SENSORIAL PRODUCTS

(71) Applicant: Altria Client Services LLC, Richmond, VA (US)

(72) Inventors: Munmaya K. Mishra, Manakin Sabot, VA (US); Jason Flora, Richmond, VA (US); Georgios D. Karles, Richmond, VA (US); Christophe Claude Galopin, Chesterfield, VA (US); Diane Gee, Chesterfield, VA (US); John B. Paine, III, Midlothian, VA (US); Douglas Antonio Fernandez, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 57 days.

(21) Appl. No.: 16/194,787

(22) Filed: Nov. 19, 2018

(65) Prior Publication Data

US 2019/0082730 A1 Mar. 21, 2019

Related U.S. Application Data

(63) Continuation of application No. 14/206,515, filed on Mar. 12, 2014, now Pat. No. 10,130,120.

(60) Provisional application No. 61/799,428, filed on Mar. 15, 2013.

(51) Int. Cl.

| | |
|---|---|
| ***A24B 15/40*** | (2006.01) |
| ***A24B 15/30*** | (2006.01) |
| ***A24B 13/00*** | (2006.01) |

(52) U.S. Cl.

CPC ..... *A24B 15/403* (2013.01); *A24B 13/00* (2013.01); *A24B 15/30* (2013.01); *A24B 15/301* (2013.01); *A24B 15/302* (2013.01)

(58) Field of Classification Search

None

See application file for complete search history.

(56) References Cited

U.S. PATENT DOCUMENTS

| | | | | |
|---|---|---|---|---|
| 3,746,012 | A * | 7/1973 | Deszyck | A24B 15/12 131/370 |
| 3,861,400 | A | 1/1975 | Perkins et al. | |
| 4,142,535 | A | 3/1979 | Perkins et al. | |
| 4,674,519 | A | 6/1987 | Keritsis et al. | |
| 5,525,351 | A | 6/1996 | Dam | |
| 5,567,462 | A | 10/1996 | Ehrlich | |
| 5,935,604 | A | 8/1999 | Illum | |
| 6,110,495 | A | 8/2000 | Dam | |
| 6,432,440 | B1 | 8/2002 | Watts et al. | |
| 6,607,752 | B2 | 8/2003 | Bellamy et al. | |
| 8,042,552 | B2 | 10/2011 | Xue et al. | |
| 8,733,369 | B2 | 5/2014 | Rees et al. | |
| 2004/0194793 | A1 | 10/2004 | Lindell et al. | |
| 2006/0147498 | A1 | 7/2006 | Jonsson et al. | |
| 2006/0275344 | A1 | 12/2006 | Mody et al. | |
| 2008/0286340 | A1 | 11/2008 | Andersson et al. | |
| 2009/0092573 | A1 | 4/2009 | Andersen | |
| 2009/0293895 | A1 | 12/2009 | Axelsson et al. | |
| 2010/0086981 | A1 * | 4/2010 | LaTouf | C12P 7/56 435/139 |
| 2010/0130562 | A1 | 5/2010 | Hite et al. | |
| 2010/0247582 | A1 | 9/2010 | Sorensen et al. | |
| 2010/0247586 | A1 | 9/2010 | Hugerth et al. | |
| 2010/0303969 | A1 * | 12/2010 | Sengupta | A23L 27/79 426/96 |
| 2011/0071184 | A1 | 3/2011 | Bunick et al. | |
| 2011/0083681 | A1 | 4/2011 | Sengupta et al. | |
| 2012/0048285 | A1 | 3/2012 | Mishra et al. | |
| 2012/0052021 | A1 | 3/2012 | Kobal et al. | |
| 2012/0128734 | A1 | 5/2012 | Hubinette et al. | |
| 2012/0247492 | A1 | 10/2012 | Kobal et al. | |
| 2013/0125904 | A1 * | 5/2013 | Chen | A24B 15/24 131/275 |

(Continued)

FOREIGN PATENT DOCUMENTS

| | | |
|---|---|---|
| GB | 1 495 941 | 12/1977 |
| WO | WO 2010/104464 | 9/2010 |

OTHER PUBLICATIONS

Definition of "complex", IUPAC. Compendium of Chemical Terminology, 2nd ed. (the "Gold Book"), [online], [retrieved on Jun. 24, 2014], Retrieved from the Internet: <URL: http://goldbook.iupac.org (2006-)>. (Year: 2006).*

International Search Report dated Jun. 26, 2014, for International Patent Publication No. PCT/US2014/025931.

Polysacharrides (Sugars, Gums) Used in Cosmetics, Making Cosmetics Inc., no date, [online], retrieved from the Internet,[retrieved Apr. 4, 2015], <URL: http://www.makingcosmetics.com/articles/20-polysaccharides-sugars-gu ms-in-cosmetics. pdf>.

Definition of complex, Chemistry Dictionary, no date, [online], retrieved from the Internet, [retrieved Apr. 4, 2015], <URL:http://www.chemicool.com/definition/complex.html>.

(Continued)

*Primary Examiner* — Dennis R Cordray

(74) *Attorney, Agent, or Firm* — Harness, Dickey & Pierce, P.L.C.

(57) ABSTRACT

The use of pectins and/or polymers to prevent nicotine oxidation in tobacco containing products is disclosed. These polymers may be naturally occurring anionic polymers or synthetic polymers. These pectins and/or polymers prevent nicotine from oxidizing into cotinine, nicotine-cis-N-oxide, nicotine-trans-N-oxide, and/or nicotine-1,1-di-N-oxide. Molluscicides, algaecides, pesticides, and stabilized nicotine compositions comprising nicotine and pectin, anionic polymers, or combinations thereof are disclosed.

12 Claims, No Drawings

(56) References Cited

U.S. PATENT DOCUMENTS

2013/0192620 A1 8/2013 Tucker et al.

OTHER PUBLICATIONS

Definition of "complex", IUPAC Gold Book, 1994, [online], retrieved from the Internet, [retrieved Jun. 24, 2014], <URL:http://goldbook.iupac.org/C01203.html>.

* cited by examiner

USE OF PECTIN OR OTHER ANIONIC POLYMERS IN THE STABILIZATION AND CONTROLLED RELEASE OF NICOTINE IN ORAL SENSORIAL TOBACCO PRODUCTS OR NICOTINE CONTAINING NON-TOBACCO ORAL SENSORIAL PRODUCTS

CROSS-REFERENCE TO RELATED APPLICATIONS

This application is a continuation application of U.S. patent application Ser. No. 14/206,515, filed on Mar. 12, 2014, now U.S. patent Ser. No. 10/130,120, issued on Nov. 20, 2018, which claims priority to U.S. Provisional Patent Application Ser. No. 61/799,428, filed on Mar. 15, 2013, which are incorporated herein by reference in their entirety for all purposes.

BACKGROUND

Nicotine is a well-known and highly characterized naturally occurring alkaloid found in the tobacco plant, *Nicotiana tabacum*. Under ambient conditions, nicotine is an oily, volatile, hygroscopic liquid that is sensitive to light and air. Due to its volatility, nicotine may evaporate during its processing. Additionally, the nitrogen in the pyrrolidinic ring can undergo protonation in the presence of an acid. Further, any nicotine free base present in an article is susceptible to oxidation through an electrophilic attack.

Thus, the stabilization of nicotine in oral sensorial tobacco products, or nicotine containing non-tobacco oral sensorial products, is desirable.

SUMMARY

The present disclosure is related to the use of pectins and/or polymers to prevent nicotine oxidation in tobacco containing products. In one embodiment, the use of pectins and/or polymers to prevent nicotine oxidation in tobacco containing products, wherein said polymers are naturally occurring anionoic polymers is disclosed. In another embodiment, the use of pectins and/or polymers to prevent nicotine oxidation in tobacco containing products, wherein said polymers are synthetic polymers is disclosed. In another embodiment, the use of pectins and/or polymers to prevent nicotine oxidation in tobacco containing products, wherein nicotine is prevented from oxidizing into cotinine, nicotine-cis-N-oxide, nicotine-trans-N-oxide, and/or nicotine-1,1-di-N-oxide is disclosed. In another embodiment, a method of preventing nicotine oxidation in tobacco containing products comprising mixing the tobacco with pectins and/or polymers is disclosed.

One embodiment is a process for preventing nicotine oxidation in tobacco containing products comprising pectin and/or anionic polymers, which can form salts with protonated forms of nicotine that are typically present below pH levels of around 9 or so, can act like an ion-exchange resin and hold nicotine in close proximity by electrostatic attraction.

Another embodiment is a method for stabilizing nicotine comprising employing pectin and/or an anionic polymer at a pH of around 6 (above pH values of about 4 or so and below pH levels of about 9).

Another embodiment is a method for reducing the formation of oxidation products from nicotine comprising employing pectin and/or an anionic polymer.

Another embodiment is a molluscicide composition comprising nicotine and pectin, an anionic polymer, or a combination thereof, wherein said pectin, an anionic polymer, or a combination thereof stabilizes said nicotine.

Another embodiment is an algaecide composition comprising nicotine, and pectin, an anionic polymer, or a combination thereof, wherein said pectin, an anionic polymer, or a combination thereof stabilizes said nicotine.

Another embodiment is a pesticide composition comprising nicotine, and pectin, an anionic polymer, or a combination thereof, wherein said pectin, an anionic polymer, or a combination thereof stabilizes said nicotine.

Another embodiment is a stabilized nicotine composition comprising nicotine, and pectin, an anionic polymer, or a combination thereof, wherein the pH of said composition is above pH values of about 4 or so and below pH levels of about 9.

A further embodiment is a controlled-release nicotine composition comprising nicotine, and further comprising pectin, an ionic polymer, or a combination thereof.

Another embodiment is a method for controlling the release of nicotine comprising complexing nicotine with a pectin, an anionic polymer, or a combination thereof at a pH of above pH values of about 4 or so and below pH levels of about 9.

A further embodiment is a controlled-release nicotine article comprising pectin, an anionic polymer, or a combination thereof. Further envisioned is a controlled-release nicotine article comprising pectin, an anionic polymer, or a combination thereof, wherein the article is a lit-end cigarette, an electrically heated cigarette, chewing tobacco, snus, dry snuff, moist snuff, tablets, sticks, strips, pouched products, chewable gum, or a wrapper.

DETAILED DESCRIPTION

Nicotine, or 3-[(2S)-1-methylpyrrolidin-2-yl]pyridine, is a tertiary amine with the following structure:

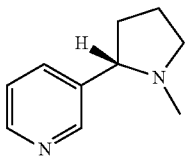

Nicotine constitutes approximately 0.6-3.0% of the dry weight of tobacco. Nicotine has numerous commercial uses including as a fumigant, an insecticide, and in smoking articles such as cigarettes, cigars, and in pipes and smokeless tobacco products such as chewing tobacco, snuff, pouches and gum. It is well known that nicotine oxidation is catalyzed by light and that nicotine is more stable in its protonated form. In nicotine chewing gum products (pharmaceutical products designed for smoking cessation therapy) the nicotine can be bound to the weak cation-exchanger polyacrilex to prevent oxidation.

It is desirable to prevent the oxidation of the nicotine in smoking articles and smokeless tobacco products. A common method to reduce the processing and stability issues associated with the nicotine compound involves the preparation of a complex of nicotine and an ion exchange resin. Nicotine ion exchange complexes are described in U.S. Pat. Nos. 5,935,604 and 6,607,752 and U.S. Pat. App. Pub. Nos. 2009/0092573 and 2010/0130562.

Ion exchange resins are characterized by their capacity to exchange ions. The ion exchange capacity is measured as the number of equivalents of an ion that can be exchanged and can be expressed with reference to the mass of the polymer or its volume. Ion exchange resins are known in the art and can be manufactured in forms such as spherical and non-spherical particles with size in the range of 0.001 mm to 2 mm.

Pectins are natural polymers related to carbohydrates, except that C-6 contains a fully oxidized carboxylic acid (or corresponding methyl ester or carboxamide) group instead of a hydroxymethyl group. The principal subunit is known as galacturonic acid, which can be copolymerized with L-rhamnose. Other sugars are featured as side-chain substituents. The carboxylic acid form, more particularly the carboxylate anionic form present at pH values above about 4 or so, forms "salts" with protonated forms of nicotine that are typically present below pH levels of around 9 or so.

Provided herein is the use of pectins combined with nicotine or nicotine-containing tobacco extracts to create reconstituted tobaccos or other nicotine-containing materials that can be used in an oral sensorial (including chewable) product. Chewable products include chewing tobacco, snus, dry snuff, moist snuff, tablets, sticks, strips, pouched products, chewable gum, spongy material, or combination of these.

An embodiment is the use of pectins and/or polymers to prevent nicotine oxidation in tobacco containing products. These polymers may be naturally occurring anionic polymers or synthetic polymers. Described herein is a use wherein nicotine is prevented from oxidizing into cotinine, nicotine-cis-N-oxide, nicotine-trans-N-oxide, and/or nicotine-1,1-di-N-oxide.

Also described is the use of pectin to allow greater recovery of nicotine from tobacco-processing streams involved in reconstituted-leaf production for lit-end cigarettes and electrically heated cigarettes. If the more soluble versions of anionic pectins are used and ingested, they will continue to bind nicotine.

If the pectin used has low water-solubility, the pectin, within the appropriate pH range, can act like an "ion-exchange resin," and hold nicotine in close proximity by electrostatic attraction that is characteristic of ionized salts. Natural tobacco pectins attract nicotine at pH levels of around 6, which can prolong the release of nicotine when such tobaccos are chewed or otherwise exposed to saliva in the mouth.

Pectin may be extracted from tobacco, but also commercially available pectin isolated from sources such as apple pomace, citrus peels, sugarbeet waste from sugar manufacturing, sunflower heads discarded from seed harvesting, mango waste, and other commercially available pectins may be used.

Physical properties of several types of pectin suitable for use herein are provided in Table 1.

TABLE 1

PHYSICAL PROPERTY DATA FOR PECTINS

| Pectin | Description | Intrinsic viscosity (dl/g) | Huggins coefficient | Solvent conditions | pH | MW |
|---|---|---|---|---|---|---|
| Sigma apple pectin | 6% ester, low ester pectin | 5.8556 | 0.0643 | Good draining | 3.389 | 613,740 |
| Genu Pectin Type X-916-02 | Amidated low ester pectin, 17% amidation, 34% ester, no sugar | 4.9261 | 0.8462 | Poor solvent conditions | 2.984 | 479,760 |
| Genu Pectin Type LM 18-CG-Z | Around 40% ester pectin, no sugar | 3.6156 | 0.827 | Poor, non-draining | 3.052 | 376,300 |
| Tobacco pectin (unwashed) | Very low ester pectin | 1.881 | 0.4154 | Very good draining | 2.983 | 259,530 |
| Tobacco pectin (dialyzed) | Very low ester pectin | 1.3514 | 0.02749 | Very good draining | 4.420 | 237,270 |

Other naturally occurring anionic polymers, or synthetic anionic polymers that have achieved GRAS status for use in foods or cosmetics, may also be used. Such polymers include carboxymethylcellulose, other carboxylated carbohydrate-derived polymers such as alginate or alginic acid, sulfated carbohydrate polymers such as carrageenan, fucoidans, heparan sulfate or heparin, and phosphorylated polymers such as deoxyribonucleic acid (DNA) or ribonucleic acid (RNA). All of these exhibit ion-exchange characteristics with respect to nicotine, within an appropriate pH range. The sulfated or phosphorylated polymers have a lower effective pH range than the carboxylate-containing polymers, due to their inherently lower pKa values, subject to chemical stability impairments that may occur under excessively acidic conditions.

Another embodiment is the use of pectins combined with nicotine or nicotine-containing tobacco extracts to create nicotine releasing wrappers of oral sensorial (including chewable) products.

The examples explained below are given by way of illustration only and should not be interpreted as constituting any limitation of the subject of the present invention.

EXAMPLES

Example 1

Nicotine and pectin compositions may be formed by mixing nicotine (about 1%-about 30%) with pectin or anionic polymer combinations (about 70%-about 99%).

While the foregoing describes in detail the use of pectin or other anionic polymers in the stabilization of nicotine in oral sensorial tobacco products or nicotine containing non-tobacco oral sensorial products with reference to specific embodiments thereof, it will be apparent to one skilled in the art that various changes and modifications equivalents to the use of pectin or other anionic polymers in the stabilization of nicotine in oral sensorial tobacco products or nicotine containing non-tobacco oral sensorial products may be employed, which do not materially depart from the spirit and scope. Accordingly, all such changes, modifications, and equivalents that fall within the spirit and scope as defined by the appended claims are intended to be encompassed thereby.

All publications cited herein are incorporated by reference in their entireties for all purposes.

What is claimed is:

1. A process for stabilizing nicotine, reducing oxidation of nicotine or both stabilizing and reducing nicotine oxidation in a composition, the process comprising:

forming a complex of nicotine and pectin by mixing 1% to 30% of the nicotine with 70% to 99% of the pectin, the pectin including a tobacco-derived pectin, wherein the tobacco-derived pectin is unwashed tobacco pectin; and incorporating the complex of nicotine and pectin in a composition including a controlled-released nicotine article, a nicotine-containing oral sensorial product, or both a controlled-released nicotine article and a nicotine-containing oral sensorial product.

2. A process for stabilizing nicotine, reducing nicotine oxidation, or both stabilizing and reducing nicotine oxidation in a composition, the process comprising:

forming a complex of nicotine and pectin by mixing 1% to 30% of the nicotine with 70% to 99% of the pectin, the pectin including a tobacco-derived pectin, wherein the tobacco-derived pectin is dialyzed tobacco pectin; and incorporating the complex of nicotine and pectin in a composition including a controlled-released nicotine article, a nicotine-containing oral sensorial product, or both a controlled-released nicotine article and a nicotine-containing oral sensorial product.

3. The process of claim 2, wherein the composition includes the nicotine-containing oral sensorial product, and the nicotine-containing oral sensorial product includes a lit-end cigarette, an electrically heated cigarette, snus, dry snuff, moist snuff, tablets, sticks, strips, wrapper, a pouched product, a spongy material product, or any combination thereof.

4. The process of claim 2, wherein the composition includes the controlled-release nicotine article, and the controlled-released nicotine article includes a lit-end cigarette, an electrically heated cigarette, snus, dry snuff, moist snuff, tablets, sticks, strips, pouched products, a wrapper, or any combination thereof.

5. The process of claim 2, wherein the pectin has a pH in a range of pH 4 to pH 9.

6. The process of claim 2, wherein nicotine oxidation into cotinine, nicotine-cis-N-oxide, nicotine-trans-N-oxide, nicotine-1,1-di-N-oxide, or any combination thereof is reduced.

7. The process of claim 2, further comprising:

forming a complex of nicotine and an anionic polymer; and incorporating the complex of nicotine and the anionic polymer in the composition.

8. The process of claim 7, wherein the anionic polymer includes a carboxylated carbohydrate-derived polymer, a sulfated carbohydrate polymer, a phosphorylated polymer, or any combination thereof.

9. The process of claim 7, wherein the anionic polymer includes carboxymethylcellulose, alginate, alginic acid, carrageenan, fucoidan, heparan sulfate, heparin, deoxyribonucleic acid (DNA), ribonucleic acid (RNA), or any combination thereof.

10. The process of claim 7, wherein the anionic polymer is synthetic.

11. A process of preparing a nicotine product comprising:

forming a mixture consisting essentially of nicotine and a pectin, the nicotine and the pectin forming a complex configured to stabilize the nicotine, reduce oxidation of the nicotine, or both stabilize the nicotine and reduce oxidation of the nicotine, wherein the pectin is a tobacco-derived pectin and the tobacco-derived pectin is unwashed tobacco pectin; and incorporating the mixture into a non-tobacco oral sensorial product.

12. A process of preparing a nicotine product comprising:

forming a mixture consisting essentially of nicotine and a pectin, the nicotine and the pectin forming a complex configured to stabilize the nicotine, reduce oxidation of the nicotine, or both stabilize the nicotine and reduce oxidation of the nicotine, wherein the pectin is tobacco-derived pectin and the tobacco-derived pectin is dialyzed tobacco pectin; and incorporating the mixture into a non-tobacco oral sensorial product.

* * * * *